US008756963B2

(12) United States Patent
Le

(10) Patent No.: US 8,756,963 B2
(45) Date of Patent: Jun. 24, 2014

(54) SEALED PUSH BUTTON LATCH

(75) Inventor: Tam Le, Santa Ana, CA (US)

(73) Assignee: S.P.E.P. Acquisition Corp., Long Beach, CA (US)

( * ) Notice: Subject to any disclaimer, the term of this patent is extended or adjusted under 35 U.S.C. 154(b) by 0 days.

(21) Appl. No.: 13/548,456

(22) Filed: Jul. 13, 2012

(65) Prior Publication Data

US 2014/0013813 A1 Jan. 16, 2014

(51) Int. Cl.
*E05B 9/08* (2006.01)

(52) U.S. Cl.
USPC ..... 70/360; 70/361; 70/370; 70/372; 70/373; 70/375; 70/451; 70/DIG. 36; 292/169; 292/170; 292/174; 292/DIG. 37; 292/DIG. 61; 292/DIG. 72

(58) Field of Classification Search
USPC ..... 70/360, 361, 368, 370, 371, 451, 70/DIG. 36, 372, 373, 375, DIG. 32, 70/DIG. 33; 292/DIG. 37, 137, 163, 169, 292/170, 174, DIG. 61, DIG. 72
See application file for complete search history.

(56) References Cited

U.S. PATENT DOCUMENTS

| | | | | | |
|---|---|---|---|---|---|
| 853,926 | A | * | 5/1907 | Hope, Jr. | 70/361 |
| 1,257,998 | A | * | 3/1918 | Gruber | 292/170 |
| 2,233,278 | A | * | 2/1941 | Aldeen | 292/191 |
| 2,322,040 | A | * | 6/1943 | Maruri | 70/145 |
| 2,660,046 | A | * | 11/1953 | Jacobi | 70/344 |
| 2,696,399 | A | * | 12/1954 | Jacobi | 292/165 |
| 2,812,205 | A | * | 11/1957 | Jakeway | 292/336.3 |
| 2,937,045 | A | * | 5/1960 | Leslie et al. | 292/336.3 |
| 3,194,596 | A | * | 7/1965 | Jakeway | 292/336.3 |
| 3,919,866 | A | * | 11/1975 | Lipschutz | 70/81 |
| 4,006,616 | A | * | 2/1977 | Rubner et al. | 70/455 |
| 4,228,667 | A | * | 10/1980 | Herriott | 70/276 |
| 4,363,230 | A | * | 12/1982 | Lipschutz | 70/370 |
| 4,777,810 | A | * | 10/1988 | Webster | 70/150 |
| 4,978,152 | A | * | 12/1990 | Bisbing | 292/169 |
| 5,263,348 | A | * | 11/1993 | Wittwer | 70/379 R |
| 5,634,359 | A | * | 6/1997 | Huebschen | 70/379 R |
| 5,722,275 | A | * | 3/1998 | Price et al. | 70/379 R |
| 5,931,035 | A | * | 8/1999 | Bolton | 70/367 |
| 6,105,405 | A | * | 8/2000 | Westwinkel | 70/371 |
| 6,209,369 | B1 | * | 4/2001 | Freck | 70/375 |
| 6,463,774 | B2 | * | 10/2002 | Sokurenko | 70/360 |
| 6,568,229 | B1 | * | 5/2003 | Heinrich | 70/370 |
| 6,880,376 | B1 | * | 4/2005 | Ko | 70/366 |
| 7,100,408 | B2 | * | 9/2006 | Nakasone | 70/375 |
| 7,194,881 | B2 | * | 3/2007 | Kutschat | 70/224 |
| 7,306,265 | B1 | * | 12/2007 | Green et al. | 292/194 |

(Continued)

*Primary Examiner* — Lloyd Gall
(74) *Attorney, Agent, or Firm* — Daniel R. Kimbell; Karish & Bjorgum PC

(57) ABSTRACT

A sealed push button latch. It includes a housing with an upper cavity and a lower cavity and a rim which provides a seal contact seat. The lower cavity has a latch opening formed therein at a first side thereof, and at least one drain/return clip aperture formed at a second side thereof. A push button with a keyed lock is slidably received in the upper cavity. A biasing device biases the push button to a closed position. A seal positioned on the push button provides sealing between the seal contact seat of the rim of the housing and the push button. A locking latch is slidably positioned in the lower cavity, and is slidably movable between a protruding position through the latch opening, and a retracted position, wherein pushing the push button down into the housing retracts the locking latch into the lower cavity.

15 Claims, 14 Drawing Sheets

(56) References Cited

U.S. PATENT DOCUMENTS 7,695,031 B2 * 4/2010 Jackson et al. ..... 292/169
8,084,701 B1 * 12/2011 Misner ..... 200/43.13
2002/0166356 A1 * 11/2002 Kuo ..... 70/361

* cited by examiner

SEALED PUSH BUTTON LATCH

BACKGROUND

The invention relates to the field of push button latches, and more particularly is a sealed push button latch that resist the ingress of moisture and debris, and has a drain feature in case moisture or debris does enter the push button latch. Push button latches are used in a variety of applications including for use in securing cabinet doors and glove box doors in a closed position, such as on golf carts and the like. Push button latches include a push button which actuates a latch which is released or retracted to allow opening of the door.

A shortcoming of existing push button latches is that they are not completely resistant to the ingress of moisture and debris, and when they become wet or inundated with debris, this can interfere with the latch's optimal operation. Moreover, when this occurs, corrosion is more likely to take place and can lead to premature failure of the latch. Lastly, the designs of many push latches remain unnecessarily complex and expensive to manufacture and assemble.

There accordingly remains a need for improved sealed push button latches that are simple in design, easy to assemble, reliable in operation, low in cost, resistant to moisture and debris infiltration, and self-draining.

SUMMARY OF THE INVENTION

The invention comprises a sealed push button latch having a housing with an outer sidewall defining an upper cavity and a lower cavity separated by a wall with an aperture. The upper cavity preferably has a vertically oriented notch on its sidewall. The lower cavity has a latch opening formed in its sidewall, and preferably has drain/return clip apertures formed on the sidewall of the housing. These drain/return clip apertures are preferably formed generally opposite the latch opening and are provided so that any liquid that might have entered to housing will freely drain therefrom, regardless of the orientation and position of the push button latch mounted to a door. The push button (with or without a keyed lock) axially moves up and down in the upper portion of the housing to actuate a latch.

In cases where the push button has an integral keyed lock, and it is desirable to provide for additional sealing between the keyed lock and the push button, a seal, e.g., such as an O-ring, will be placed in a groove formed around an outside wall of the keyed lock. The keyed lock will then be engaged with the push button, with the O-ring providing for additional sealing between the keyed lock and the push button. To provide for sealing between the push button and the housing, a seal, e.g., such as an O-ring, will be placed in a groove that will be formed around an outside wall of the push button. This O-ring will contact with the housing and help prevent the ingress of water and debris between the push button and the housing.

The push button (or its keyed lock) connects at its bottom to an actuator having a pin, which pin passes through the aperture in the separating wall and extends downwardly in the lower portion. A coil spring positioned in the upper cavity is placed above the separator wall and around the actuator's pin and pushes it up into contact with the push button. This also biases the push button upwardly. A latch leg with a protrusion extending downwardly from the push button is aligned so that the protrusion is received in the vertically oriented notch on the sidewall of the housing, and prevents the push button from becoming separated from the upper cavity of the housing. In cases where the push button has a keyed lock, turning the keyed lock will rotate the actuator. The actuator has tabs and grooves formed thereon, which when turned by the keyed lock in a locked position will be aligned with stop rails and a guide rail formed on the inside wall of the upper cavity to prevent the push button from being depressed and actuating the locking latch. When the keyed lock is in its opened position, the actuator will be rotated such that its tabs and grooves clear the stop rails and the guide rail of the housing, so that the push button is free to be pushed down to operate the locking latch.

The locking latch is located in the lower cavity. The locking latch has an outwardly facing slanted slam surface and an interior ramp surface which is aligned to be impinged by downward motion of the actuator's pin. In an extended mode of the locking latch, the outwardly facing slanted slam surface will project out of the housing. The slanted slam surface and the interior ramp surface both slant inwardly and downwardly towards the middle of the locking latch. A latch spring is located in the lower cavity and acts to bias the locking latch to project outside of the housing. The locking latch is adapted to be moved back into the lower housing portion in response to both a downward movement of the actuator and its pin, which pin impinges on the ramp surface, and the impact of the slanted slam surface of the locking latch with a strike plate.

An optional return clip can be engaged with the housing to help maintain a tight and vibration-free contact between the sealed push button latch and the door frame to which the door is hinged, and also helps to pop open the closed door. The return clip will include a front lip portion from which extends two spaced apart forks. At the ends of the spaced apart forks are protrusions. The spaced apart forks are inserted into the latch opening above the locking latch, and the protrusions are passed through the drain/return clip apertures and thus secure the return clip to the housing.

DETAILED DESCRIPTION OF THE INVENTION

Figure 1:
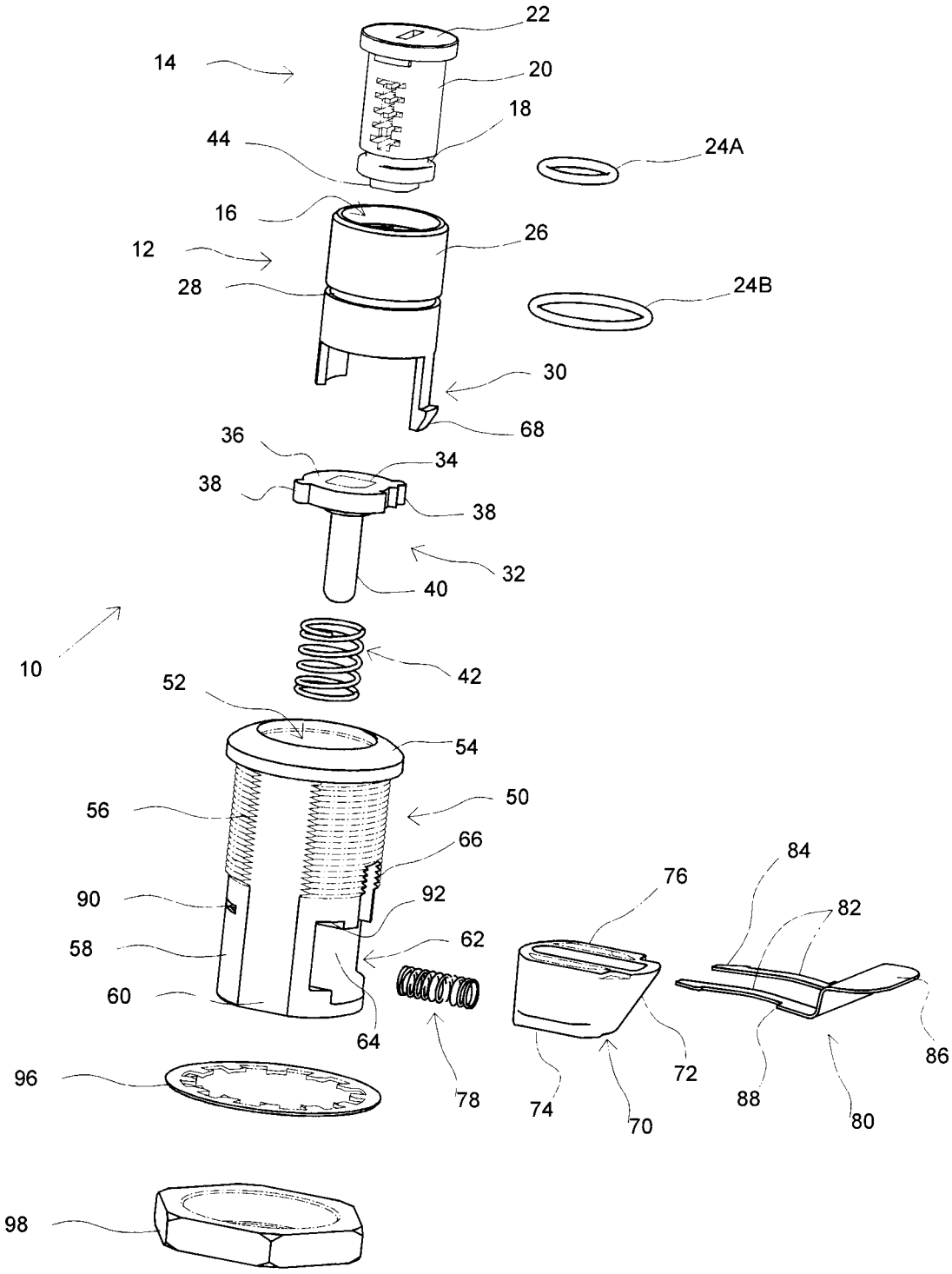
FIG. 1 is an exploded view showing various parts of an exemplary embodiment of a sealed push button latch of the invention.

Turning now to the drawings, FIG. 1 is an exploded view showing various parts of an exemplary embodiment of a sealed push button latch 10 of the invention. It includes a push button 12, and in the case where a locking feature is desired, a keyed lock 14. An opening 16 is formed in the push button 12 into which the keyed lock 14 is inserted. For provision of improved sealing between the keyed lock 14 and the push button 12, a groove 18 is formed around an outside wall 20 of the keyed lock 14. The keyed lock 14 has a head 22 with a key entrance. A seal, such as an O-ring 24A, is placed in the groove 18. The push button 12 has an outer wall 26 on which is formed an optional groove 28. For provision of improved sealing between the push button 12 and a housing 50 into which the push button 12 engages, a seal, such an O-ring 24B, is placed in the groove 28. The push button 12 has a latch leg 30. An actuator 32 is provided which is adapted to engage with the keyed lock 14. The actuator 32 has an engagement 34 formed on its head 36. The head 36 has tabs 38 formed thereon, the purpose of which will be described further below. A pin 40 extends downwardly from the head 36. A coil spring 42 is placed around the pin 40 and biases the actuator 32 upwardly so that the engagement 34 in the head 36 of the actuator is brought into contact with a complementary engagement 44 on the bottom of the keyed lock 14, which when the keyed lock is turned, will cause the actuator 32 to also rotate. The housing 50 has an upper opening sometimes referred to herein as a push button bore 52 sized to slidably receive the push button 12. The housing 50 also has an enlarged retention head 54, and preferably has threads 56 formed on an outer wall 58 of the housing 50 below the retention head 54. The housing 50 is preferably non-cylindrical, e.g., it can have flats 60 formed on sides thereof, to prevent the housing 50 from rotating once it is mounted in place, such as on a door "D", as best shown in FIGS. 23-26. A latch opening 62 is formed through the outer wall 58 and communicates with a lower cavity 64 of the housing 50. A vertically oriented notch 66 is formed in the sidewall 58 of the housing 50, and is adapted to receive the latch leg 30 of the push button 12. The latch leg 30 has a protrusion 68 at its end which will be captured in the vertically oriented notch 66 and prevent the push button 12 and its keyed lock 14 from being completely withdrawn from the housing 50 once the push button 12 has been inserted therein. This likewise makes assembly of the sealed push button latch of the invention extremely simple and a tool-free operation.

A locking latch 70 is adapted to be received in the lower cavity 64 and transversely slide therein and be extendable outside of the latch opening 62. The locking latch 70 has a front slanted slam surface 72 which extends up and out from a bottom 74 to a top 76 of the locking latch 70. A latch spring 78 is placed in the lower cavity 64 between the locking latch 70 and acts to bias the locking latch 70 so that its front slanted slam surface 72 extends outside of the latch opening 62, as shown FIGS. 14-16 and 21. An optional return clip 80 can be used to help stabilize the sealed push button latch 10 when it is latched to a frame and prevent the door from rattling. The return clip 80 has two spaced apart forks 82 with protrusions 84 at ends thereof, and a front lip portion 86. Stops 88 are located rearwardly of the lip 86. As the return clip 80 is engaged with the housing 50, the two spaced apart forks 82 will flex together and the protrusions 84 at the ends of the forks 82 will pass through drain/return clip apertures 90 formed through the outer wall 58 of the housing 50 opposite the latch opening 62. If desired, additional indents 92 can be formed at the top of the lower cavity at the entrance of the latch opening 62 to accommodate the passage of the forks 82. After the return clip 80 is fully inserted into place with the housing 50, the stops 88 will rest against the outer wall 58 of the housing 50 and the two forks 82 will spring apart and the protrusion 84 will lock in place in the drain/return clip apertures 90. A lock washer 96 and nut 98 are used to retain the sealed push button latch 10 to a closure, such as a door "D", as shown in FIGS. 23-26.

Figure 2:
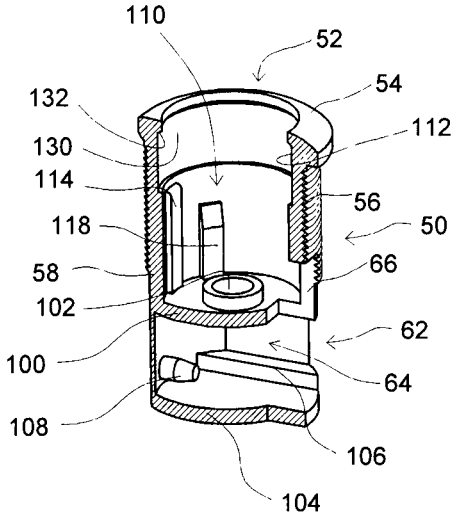
FIG. 2 is a partially exposed view of the housing of the push button latch of FIG. 1.
Figure 3:
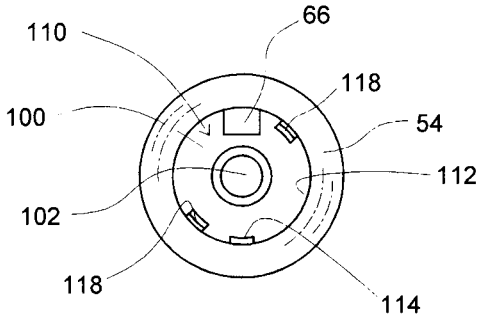
FIG. 3 is a top view of the housing of the push button latch of FIG. 1.
Figure 20:
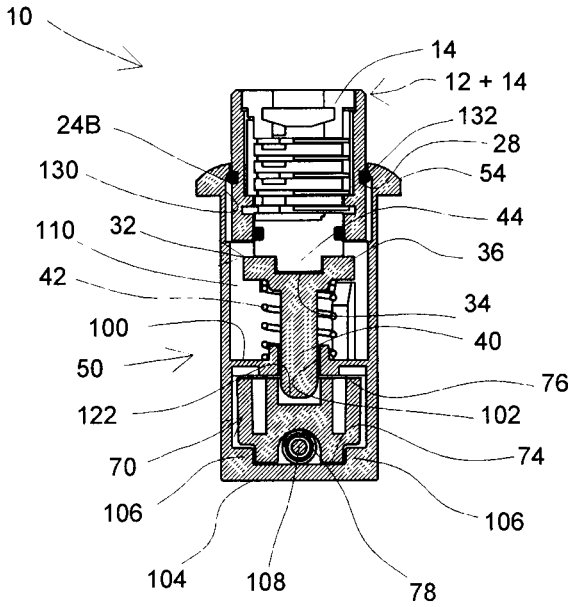
FIG. 20 is a longitudinal cross-section view of the assembled push button latch through view lines 20-20 of FIG. 14 with the push button in an un-depressed mode and with the locking latch projecting outside of the housing.
Figure 21:
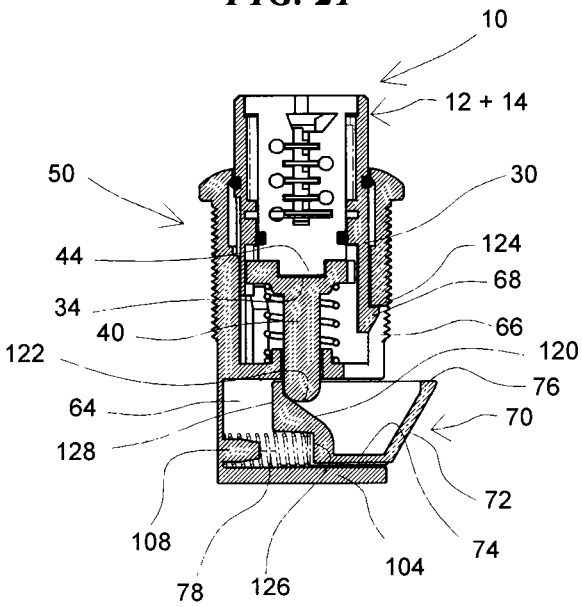
FIG. 21 is longitudinal cross-section view of the assembled push button latch of through view lines 21-21 of FIG. 15 and with the locking latch projecting outside of the housing.
Figure 22:
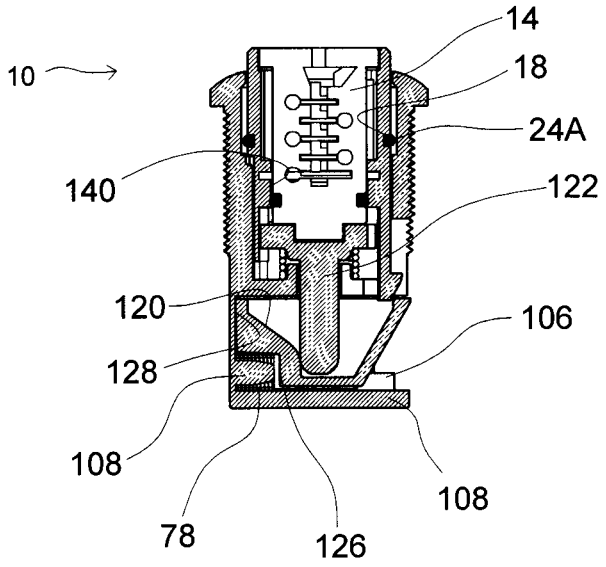
FIG. 22 is a longitudinal cross-section view of the assembled push button latch with the push button in a depressed mode to retract the locking latch into the housing.

FIG. 2 is a partially exposed view of the housing 50 of the push button latch 10 of FIG. 1, and FIG. 3 is a top view of same. The housing 50 includes the upper opening 52 sized to slidably receive the push bottom 12 (not shown). The housing 50 also has an oversized retention head 54 that will seat on an aperture formed in closure, such as shown in FIGS. 23-26. The housing 50 preferably has threads 56 formed on its outer wall 58 below the head 54. The latch opening 62 is formed through the sidewalls and communicates with a lower cavity 64 of the housing 50. The vertically oriented notch 66 is formed in the sidewall 58 of the housing 50. A dividing wall 100 is located above the lower cavity and has an aperture 102 through which will pass the pin 40 of the actuator 32, as shown in FIGS. 20-22. The lower cavity 64 has a lower end wall 104, which can have tracks 106 formed thereon to guide the sliding motion of the locking latch 70, as shown in FIG. 20. A spring keeper 108 is used to retain the coil spring 78 in place. Above the dividing wall 100 is the upper cavity 110. It is in the upper cavity 110 that the push button 20 is received. Formed on inside walls 112 of the housing 50 is an elongate push button guide rail 114. The push button 20 has a complementary elongate slot 116 formed on an outer surface thereof (see FIG. 4), and when the push button 20 is placed in the upper cavity 110, the push button 20 will thereby be allowed to move up and down but not rotate by virtue of the elongate push button guide rail 114 riding in the complementary elongate slot 116. Also located on the inside sidewalls of the upper cavity 110 are stops 118. The stops 118 are designed so that when the keyed lock 14 is operated and its locked position, the actuator 32 will be turned so that its tabs 38 will be aligned to intersect with the stops 118, and thereby prevent the push button 12 from being pushed down. However, when the keyed lock 14 is in its opened position, the actuator 32 is turned so that its tabs 38 clear the stops 118, thereby allowing the push button 12 to be pushed down. The upper region of the upper cavity 110 is defined by smooth inner sidewalls 130 which will provide a contact surface for the O-ring 24B on the push button 12 in the groove 28 to ride along and provide a water tight yet moveable seal, which is best shown in FIGS. 20-22. An inner rim 132 is formed along the inside of the retention head 54 extends slightly inwardly to create a slightly smaller diameter opening.

Figure 4:
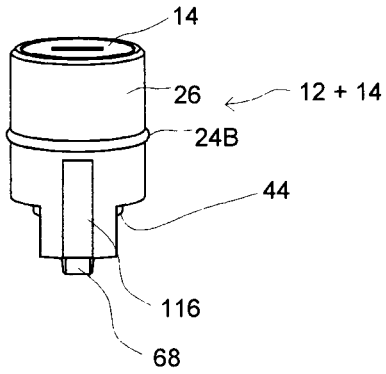
FIG. 4 is a perspective view of the push button and its engaged keyed lock of the push button latch of FIG. 1.
Figure 5:
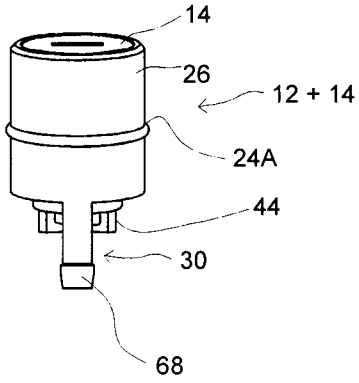
FIG. 5 is another perspective view of the push button and its engaged keyed lock of FIG. 4, but rotated by 180 degrees.
Figure 6:
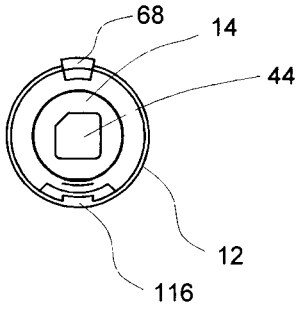
FIG. 6 is a bottom view of the push button and keyed lock of the push button latch of FIG. 1.

FIG. 4 is a first side view of the push button assembled with its keyed lock 12+14 of the push button latch of FIG. 1, and FIG. 5 is another side view of same rotated along its axis by 180 degrees. FIG. 6 is a bottom view of same. The push button 12 has an outer wall 26 with an O-ring 24B placed in the groove thereon (not shown). The latch leg 30 with it protrusion 68 are also shown. Also shown is the complementary engagement 44 on the bottom of the keyed lock 14, and the elongate slot 116.

Figure 7:
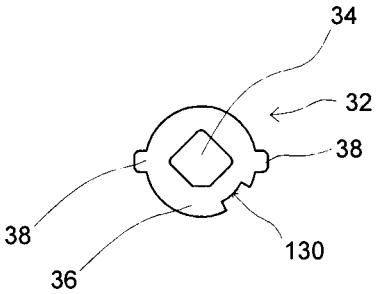
FIG. 7 is a bottom view of the actuator of the push button latch of FIG. 1.

FIG. 7 is a bottom view of the actuator 32. The engagement 34 formed on its head 36 and the tabs 38 formed thereon are shown. Also shown is a notch 130. The notch is designed to allow the latch leg 30 and its terminal protrusion 68 to swing inwardly as the push button 12 is slid into the upper cavity 110 during assembly of the push button lock.

Figure 8:
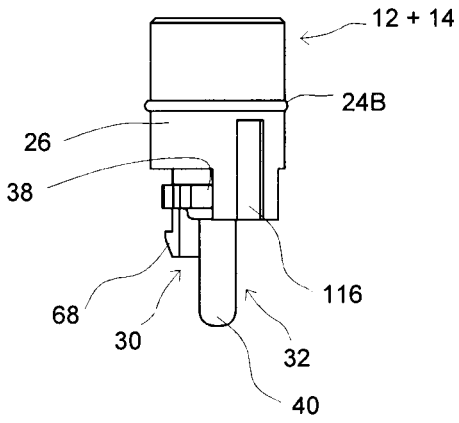
FIG. 8 is a side view of the push button and keyed lock engaged with the actuator in a locked mode.
Figure 9:
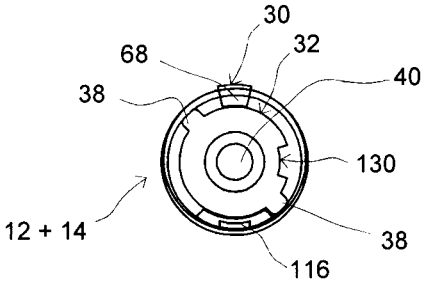
FIG. 9 is a bottom view of the push button with attached actuator in a locked mode of FIG. 8.
Figure 10:
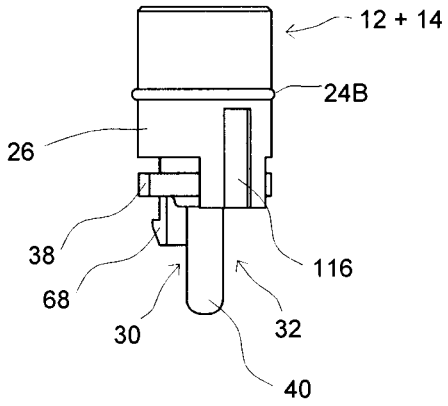
FIG. 10 is a side view of the push button with attached actuator in an unlocked mode.
Figure 11:
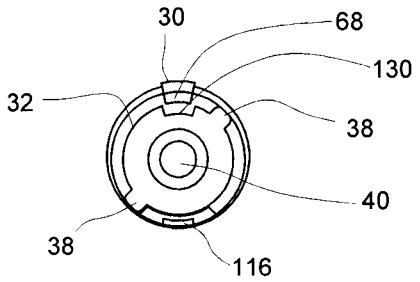
FIG. 11 is a bottom view of the push button with attached actuator in an unlocked mode of FIG. 10.

FIG. 8 is a side view of the push button with attached actuator 12+14 in a locked mode, and FIG. 9 is a bottom view of same. The O-ring 24B is positioned in the groove (not shown) in the sidewall 26 of the push button 12. The different positions of the tabs 38 are shown as the keyed lock 14 is moved from the locked mode, to the unlocked mode, shown in FIG. 10, which is a side view of the push button with attached actuator 12+14 in an unlocked mode, and FIG. 11, which is a bottom view of same. Also shown is how the notch 130 aligns with the latch leg 30 to allow it and its proximal protrusion 68 to swing inwardly during insertion of the push button lock 12 into the upper cavity 110 of the housing 50. In these views, the complementary elongate slot 116 formed on an outer surface 26 of the push button 12 is shown, as well as the pin 40 of the actuator 32.

Figure 12:
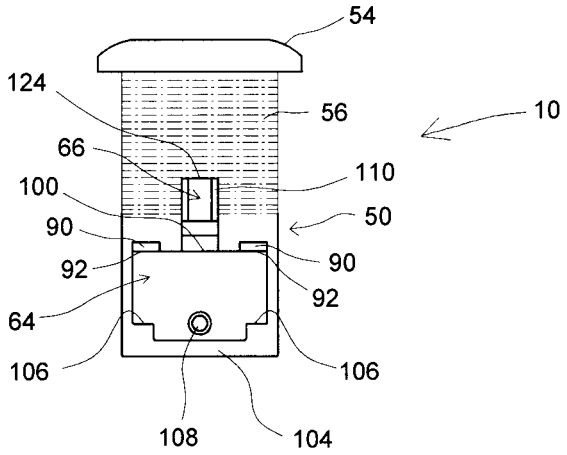
FIG. 12 is front view of the housing of the push button latch of FIG. 1.
Figure 13:
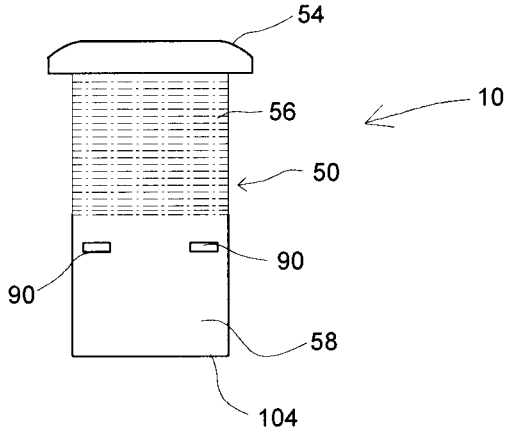
FIG. 13 is a rear view of the housing of the push button latch of FIG. 1.

FIG. 12 is front view of the housing 50 and FIG. 13 is a rear view of the housing 50 of the push button latch 10 of FIG. 1. The various features shown include the retention head 54, the threads 56 formed on the outer wall 58 of the housing below the head 54, the drain/return clip apertures 90, indents 92, the vertically oriented notch 66, its upper end 124, the dividing wall 100 between the lower cavity 64 and the upper cavity, the lower end wall 104 with its tracks 106, and the spring keeper 108.

Figure 14:
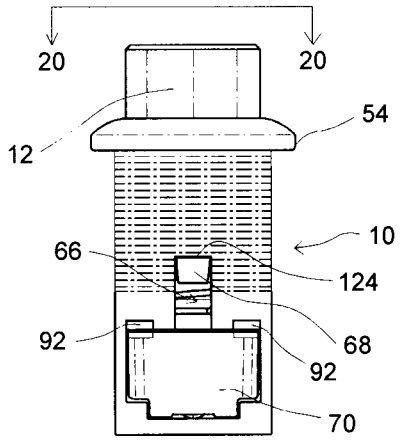
FIG. 14 is a front view of the exemplary embodiment of the assembled push button latch of FIG. 1.
Figure 15:
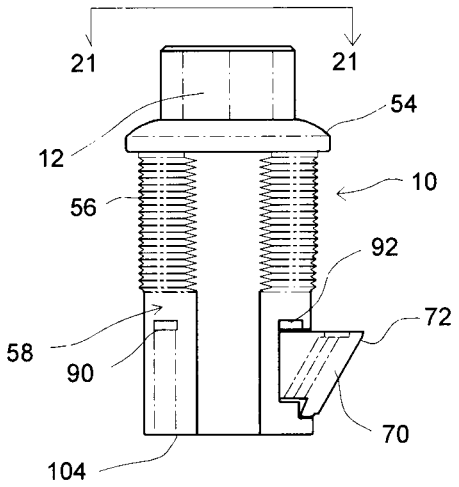
FIG. 15 is a left side view of the exemplary embodiment of the push button latch of FIG. 14.
Figure 16:
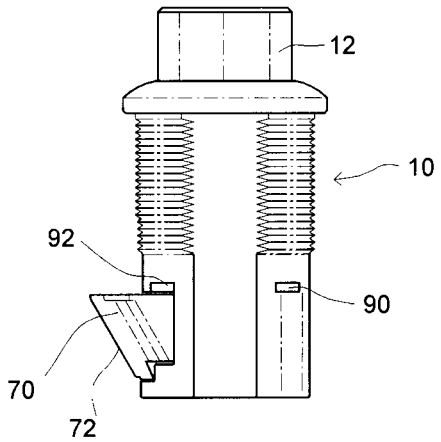
FIG. 16 is a right side view of the exemplary embodiment of the push button latch of FIG. 14.
Figure 17:
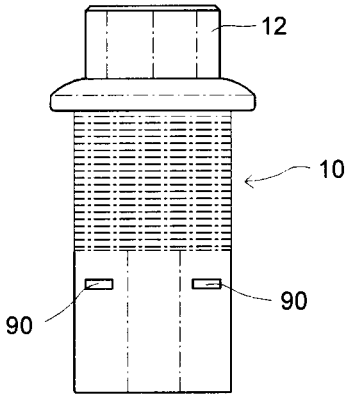
FIG. 17 is a back view of the exemplary embodiment of the push button latch of FIG. 14.
Figure 18:
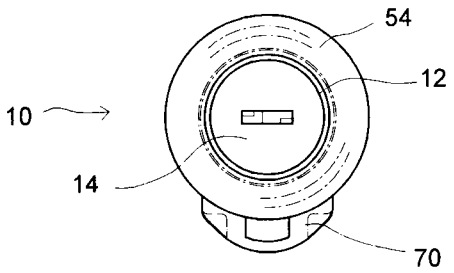
FIG. 18 is a top view of the exemplary embodiment of the push button latch of FIG. 14.
Figure 19:
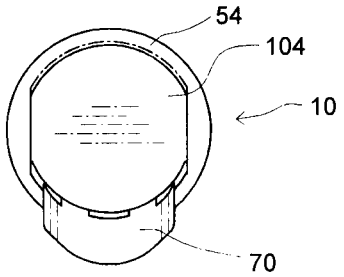
FIG. 19 is a bottom view of the exemplary embodiment of the push button latch of FIG. 14.

FIG. 14 is a front view, FIG. 15 is a left side view, FIG. 16 is a right side view, FIG. 17 is a back view, FIG. 18 is a top view, and FIG. 19 is a bottom view of the exemplary embodiment of the assembled push button latch 10. In these views there are shown the push button 12, the keyed lock 14, the retention head 54, the threads 56 formed on the outer wall 58 of the housing below the head 54, the drain/return clip apertures 90, the indents 92, the vertically oriented notch 66, and the protrusion 68 on the latch leg 30 (not shown), which protrusion 68 captures at the upper end 124 of the vertically oriented notch 66, the locking latch 70 with its front slanted slam surface 72, and the lower end wall 104. In FIG. 18 the keyed locked 14 is shown.

Turning to FIGS. 20-22, there are shown various cross-sections views of the push button latch 10. FIG. 20 is a longitudinal cross-section view of the assembled push button latch 10 through view lines 20-20 of FIG. 14 with the push button 10 in an un-depressed mode with the locking latch 70 extending outside of the housing 50. FIG. 21 is longitudinal cross-section view of the assembled push button latch through view lines 21-21 of FIG. 15 with the push button in an un-depressed mode. Lastly, FIG. 22 is a longitudinal cross-section view of the assembled push button latch with the push button in a depressed mode to retract the latch into the housing. The push button and its keyed locked 12+14 are retained in the upper cavity 110 by virtue of the protrusion 68 on the latch leg 30 being captured at the upper end 124 of the vertically oriented notch 66. A lower end 122 of the pin 40 of the actuator 32 will pass through the aperture 102 in the dividing wall 100 and contact an inwardly slanted surface 120 of the locking latch 70. One end of the coil spring 78 is retained by the spring keeper 108 and the other end of the coil spring 78 is retained in a tunnel 126 formed through a back wall 128 of the locking latch 70. The bottom 74 of the locking latch 70 rides on the lower end wall 104 of the housing and the track 106 located therein, and the top 76 of the locking latch 70 rides generally below the dividing wall 100. The upwardly and outwardly slanted surface 72 of the locking latch is available for contact with a slam surface, such as a catch on a door frame (not shown.) The coil spring 78 will provide a biasing force that tends to bias the locking latch 70 out of the latch opening 62 of the lower cavity 64, with the lower end 122 of the pin 40 extending into the locking latch 70 to prevent it from becoming completely separated from the lower cavity 64. The coil spring 42 is placed around the pin 40 and at its upper extreme contacts an underside of the head 34 of the actuator, with the lower extreme of the coil spring 42 contacting the dividing wall 100. As can be best seen in FIG. 22, when the push button 12 is in the opened position and is pushed down into the housing 50, the lower end 122 of the pin 40 of the actuator 32 will impinge on the inwardly slanted surface 120 of the locking latch 70 and cause it to be drawn into the lower cavity 64, thereby compressing the coil spring 78. In these figures, the O-ring 24B is seated in the groove 28 on the push button 12 and will lightly ride along the inside walls 130 of the housing 50 to provide a water resistant seal therewith. In the locked position shown in FIGS. 20 and 21, the O-ring 24B will also seat against the inner rim 132 formed along the inside of the retention head 54. This seating of the O-ring 24B with the inner rim 132 will help prevent the chance for water, other fluids, or debris from entering the push button lock. Indeed, in the normal condition, the push button latch 10 will be un-depressed, and therefore, a good seal will be maintained. When the push button 12 is depressed, however, the O-ring 24B will be moved out of contact with the inner rim 132, and therefore, a less tight seal between the O-ring 24B and the inside walls 130 is required, thereby helping to ensure that the operation of the push button latch is smooth and unimpeded. This also eliminates the need for an unnecessary strong coil spring 42 to return the push button 12 to its locked position of FIGS. 20 and 21. Also shown is the locking engagement between the engagement 34 in the head 36 of the actuator 32 and the complementary engagement 44 of the keyed lock 14. The coil spring 42 ensures that the actuator 32 is maintained in contact with the keyed lock 14. Also shown is the O-ring 24A which is placed in the groove 18 on the outside wall 20 of the keyed lock 14. Once the keyed lock 14 is inserted into the push button 12, its locks into place, and the O-ring 24A helps prevent any moisture or debris from traveling between the outside walls of the keyed lock 14 and the inside 140 of the inner walls of the push button 12.

Figure 23:
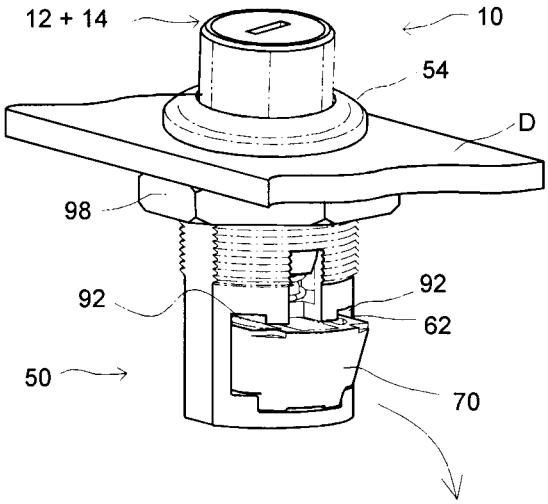
FIG. 23 is a left side perspective view of the push button latch of FIG. 14 mounted on a door in a horizontal position.
Figure 24:
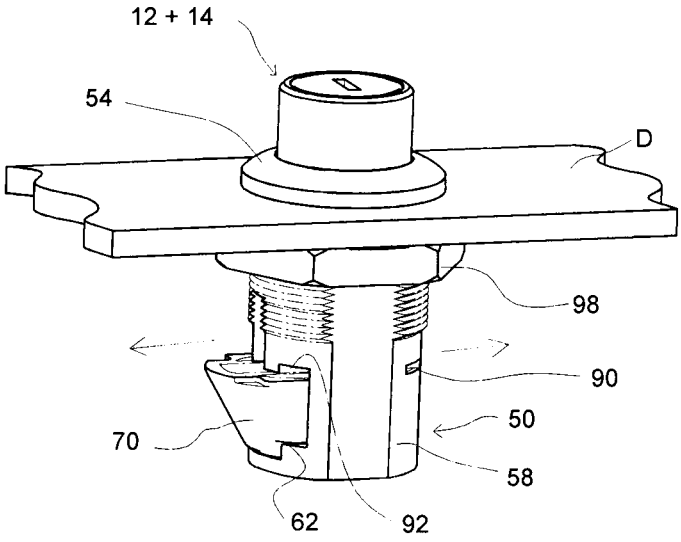
FIG. 24 is a right side perspective view of the push button latch of FIG. 14 mounted on a door in a horizontal position.

FIG. 23 is a left side perspective view of the push button latch 10 of FIG. 15 mounted on a door "D" which is in a generally horizontal position and FIG. 24 is a right side perspective view of the push button latch 10 mounted on door "D" which is in a generally a horizontal position. The nut 98 is used to retain the sealed push button latch 10 with its retention head 54 resting on one side of the door "D" and with the push button and keyed lock 12+14 accessible on an "outside" of the door "D". In case moisture or debris were to enter the sealed push button lock 10 from the outside, such moisture could pass though the housing 50 and exit through the latch opening 62 formed in the housing 50 around edges of the locking latch 70, and/or thorough the drain/return clip apertures 90 formed through the outer wall 58 of the housing 50.

Figure 25:
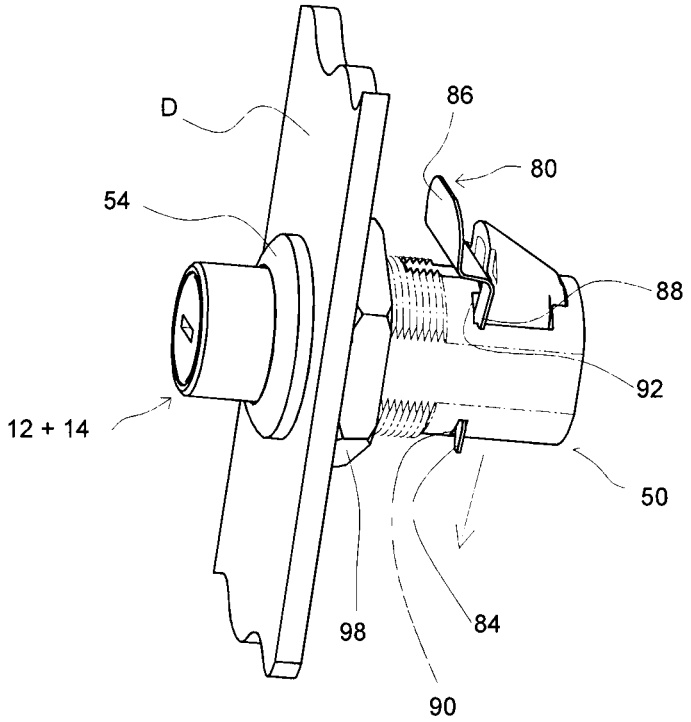
FIG. 25 is a left side perspective view of the push button latch of FIG. 14 mounted on a door which is canted slightly from a vertical position and with its locking latch directed generally upwards and with its drain/return clip apertures directed generally downwards.
Figure 26:
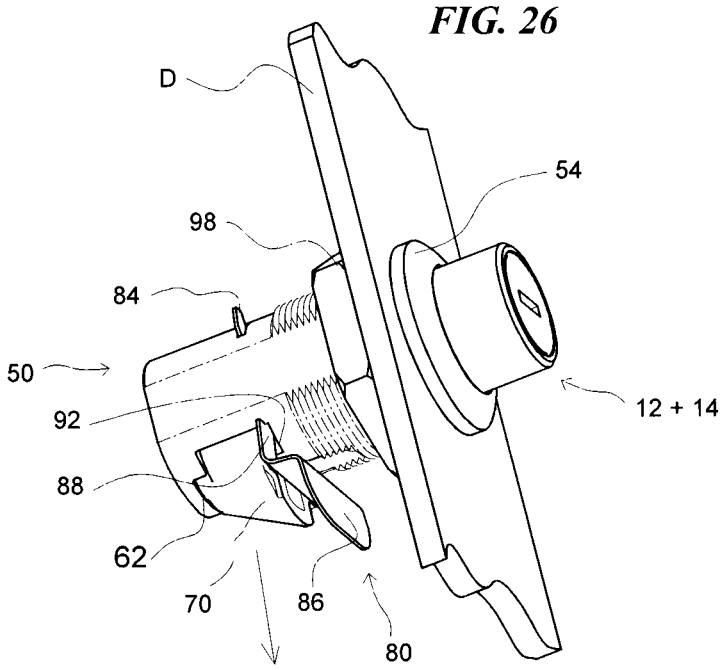
FIG. 26 is a left side perspective view of the push button latch of FIG. 16 mounted on a door which is canted slightly from a vertical position and with its locking latch directly generally downwards.

FIG. 25 is a left side perspective view of the push button latch 10 mounted on the door "D" and being canted slightly from a vertical position and with its locking latch 70 directly generally upwardly and with the drain/return clip apertures 90 being at a lower point. In this position, any moisture that might have entered the push button latch 10 can drain out through the drain/return clip apertures 90, which are not completely blocked by the retention clip 80. FIG. 26 is a left side perspective view of the push button latch 10 mounted on the door "D" and being canted slightly from a vertical position and with its locking latch 70 directly generally downwardly. In this position, any moisture that might have entered the push button latch 10 can drain out through the latch opening 62 formed in the housing 50. In FIGS. 25 and 26, the optional return clip 80 is engaged with the housing 50, and can be used to help prevent the door "D" from rattling when it is closed and to provide a spring force that will tend to spring the door "D" open as soon as the push button lock is activated to withdraw the locking latch 70 into the housing 50. The return clip 80 is engaged with the housing 50 so that its two spaced apart forks 82 with protrusions 84 at ends thereof are inserted into the drain/return clip apertures 90. The front lip portion 86 will extend generally above the top locking latch 70. The stops 88 located rearwardly of the front lip portion 86 will rest against the outside of the housing. As the return clip 80 is engaged with the housing 50, the two spaced apart forks 82 will flex together and the protrusions 84 at the ends of the forks 82 will pass through drain/return clip apertures 90 formed through the outer wall 58 of the housing 50 opposite the latch opening 62. Inclusion of the optional indents 92 in the housing 50 provide a place for the forks 82 to remain in place without impinge on the locking latch 70. Even when engaged with the housing, the optional return clip 80 will not interfere with draining from the drain/return clip apertures 90.

Although the sealed push button lock 10 has been described as utilizing the O-rings 24A and/or 24B to provide for improved sealing and water-tightness, if the application is one where moisture is not expected to be an issue, such as the interior of an automobile, then one or both of the seals need not be included. However, in applications where moisture and debris entering the push button lock is more of a concern, such as golf carts, which are often cleaned by spraying down with water and detergent after use, and there is a chance that water, detergent, other moisture, and debris of entering the push button lack, including the seals is highly beneficial.

Although embodiments of the present invention have been described in detail hereinabove in connection with certain exemplary embodiments, it should be understood that the invention is not limited to the disclosed exemplary embodiments, but, on the contrary is intended to cover various modifications and/or equivalent arrangements included within the spirit and scope of the present invention.

What is claimed is:

1. A sealed push button latch, comprising:

a housing with an upper cavity and a lower cavity, wherein the lower cavity has a latch opening formed therein and wherein the lower cavity includes at least one drain/return clip aperture that communicates with an interior of the housing and is generally located opposite the latch opening;

a return clip that attaches to the housing and interlocks with the at least one drain/return clip aperture without blocking the at least one drain/return clip aperture thereof;

a push button that is slidably received in the upper cavity;

a biasing device for biasing the push button to a closed position;

a seal positioned on the push button for providing sealing between the housing and the push button; and a locking latch slidably positioned in the lower cavity through the latch opening, which locking latch is slidably movable between a protruding position, and a retracted position, wherein moving the push button down into the housing retracts the locking latch into the lower cavity.

2. The sealed push button latch of claim 1, wherein the seal comprises an O-ring placed in a groove formed around an outer wall of the push button.

3. The sealed push button latch of claim 1, wherein the housing includes an inwardly extending rim which provides a seat for contact with the seal.

4. The sealed push button latch of claim 1, wherein the push button includes a keyed lock that is received in an opening in the push button.

5. The sealed push button latch of claim 4, wherein the keyed lock includes a seal extending from an outer wall of the keyed lock and contacting an inner wall of the opening in the push button.

6. The sealed push button latch of claim 4, wherein the keyed lock includes an engagement at a lower portion thereof, and the sealed push button latch further comprising an actuator which has a head that engages with the engagement of the keyed lock, and a pin, which pin protrudes downwardly and passes through an aperture formed in a dividing wall in the housing between the upper cavity and lower cavity, wherein the pin impinges on the locking latch and causes it to retract into the lower cavity when the push button is moved downwardly.

7. The sealed push button latch of claim 6, wherein the biasing device biases the actuator into locking contact with the engagement of the keyed lock.

8. The sealed push button latch of claim 1, further comprising a compression spring located in the lower cavity, which compression spring biases the locking latch to its protruding position.

9. A sealed push button latch, comprising:

a housing with an upper cavity and a lower cavity, a rim formed at an upper region of the upper cavity which rim extends into the upper cavity and provides a seal contact seat, the upper cavity and lower cavity being separated by a separating wall with an aperture formed therethrough, wherein the lower cavity has a latch opening formed therein at a first side thereof, and at least one drain aperture formed at a second side thereof;

a return clip that attaches to the housing and interlocks with the at least one drain aperture;

a push button that is slidably received in the upper cavity with a keyed lock being received in an opening in the push button;

a biasing device for biasing the push button to a closed position;

a seal positioned on the push button for providing sealing between the seal contact seat of the rim of the housing and the push button; and a locking latch slidably positioned in the lower cavity, which locking latch is slidably movable between a protruding position through the latch opening, and a retracted position, wherein pushing the push button down into the housing retracts the locking latch into the lower cavity.

10. The sealed push button latch of claim 9, wherein the seal comprises an O-ring placed in a groove formed around an outer wall of the push button.

11. The sealed push button latch of claim 9, wherein a second seal is provided on an outer wall of the keyed lock, which second seal contacts an inner wall of the opening in the push button.

12. The sealed push button latch of claim 9, wherein the keyed lock includes an engagement at a lower portion thereof, the sealed push button latch further comprising an actuator which has a head that engages with the engagement of the keyed lock, and a pin, which pin protrudes downwardly and passes through said aperture formed in said separating wall in the housing between the upper cavity and lower cavity, wherein the pin impinges on the locking latch and causes it to retract into the lower cavity when the push button is pushed down.

13. The sealed push button latch of claim 12, wherein the biasing device biases the actuator into locking contact with the engagement of the keyed lock.

14. The sealed push button latch of claim 9, further comprising a compression spring located in the lower cavity, which compression spring biases the locking latch to its protruding position.

15. A sealed push button latch, comprising:

a housing with a push button bore formed therein and a latch opening, the push button bore and the latch opening being in communication, and with a rim extending inwardly into the bore to form a seal contact seat, wherein the housing further include at least one drain/return clip aperture that is formed in a lower cavity and is generally located opposite the latch opening;

a return clip that attaches to the housing and interlocks with the at least one drain/return clip aperture without blocking the at least one drain/return clip aperture thereof;

a push button that is received in the push button bore in the housing and moves between a fully extended position, where the sealed push button latch is closed, and a depressed position, where the sealed push button latch is opened;

a seal positioned on the push button, which seal contacts with the seal contact seat when the push button is fully extended; and a locking latch slidably positioned in the lower cavity formed through the housing, which locking latch is slidably movable between a protruding position through the latch opening, and a retracted position, wherein movement of the push button down into the housing retracts the locking latch into the lower cavity.

* * * * *